United States Patent [19]

Kuhl

[11] 4,235,309

[45] Nov. 25, 1980

[54] CONTROL FOR STARTING ELECTRIC MOTORS

[75] Inventor: Joseph W. Kuhl, Toledo, Ohio

[73] Assignee: Schindler Haughton Elevator Corp., Toledo, Ohio

[21] Appl. No.: 952,301

[22] Filed: Oct. 18, 1978

[51] Int. Cl.[3] ..... B66B 1/30

[52] U.S. Cl. ..... 187/29 R; 318/742

[58] Field of Search ..... 187/29; 318/741, 742, 318/743

[56] References Cited

U.S. PATENT DOCUMENTS

| | | | |
|---|---|---|---|
| 3,599,754 | 8/1971 | Caputo et al. | 187/29 |
| 3,678,355 | 7/1972 | Bucek et al. | 318/742 X |
| 3,774,729 | 11/1973 | Winkler | 187/29 |
| 3,785,463 | 11/1974 | Kuhl et al. | 187/29 |
| 3,973,175 | 8/1976 | Anzai et al. | 318/743 |

*Primary Examiner*—Gene Z. Rubinson
*Assistant Examiner*—W. E. Duncanson, Jr.
*Attorney, Agent, or Firm*—Wilson, Fraser, Barker & Clemens

[57] ABSTRACT

This invention concerns a control for starting an electric motor such as a three phase, a.c. drive motor in an elevator system. The motor is connected to a power source through reversible contactors and back-to-back SCRs. A speed control generates a desired speed signal to SCR trigger circuits to control the flow of current in the motor and thereby maintain the desired speed. The speed control includes means responsive to a step start signal for generating the desired speed signal with predetermined values of jerk and acceleration. If the motor overspeeds, such as in a lowering load condition, the control turns off the SCRs at a first predetermined value of overspeed and reverses the contactors and turns on the SCRs at a second predetermined value of overspeed to brake the motor. The magnitude of the desired speed signal can also be increased to a value in excess of the second predetermined value of overspeed such that the motor will not hunt between the original value of the desired speed and the second predetermined value of overspeed.

14 Claims, 5 Drawing Figures

CONTROL FOR STARTING ELECTRIC MOTORS

BACKGROUND OF THE INVENTION

1. Field of the Invention

The present invention concerns an electric motor speed control in general and starting pattern control for an elevator drive motor in particular.

2. Description of the Prior Art

Many prior art elevator systems utilized a d.c. motor to drive a hoist sheave for raising and lowering the elevator cab. Typically, a.c. power was converted to d.c. power and a variable voltage control, such as a Ward-Leonard system, was utilized to control the motor at the desired speed. Where an a.c. motor has been utilized, its low starting torque has required operation at a relatively high speed with connection to the hoist sheave through a gear reduction set. Such operation produced unacceptable values of jerk and acceleration on the passengers. One attempt to overcome this problem was the use of a two speed, a.c. motor having a low speed winding for starting and a high speed winding for rated speed running. However, such a system produced an annoying jar when switching from low to high speed.

More recent developments in SCRs and thyristors have made them suitable for use in controlling motor speed. A trigger or firing angle control circuit is utilized to change the voltage applied to an induction motor to control its rotational speed from stall up to near synchronous speed. A pattern generator is utilized to generate start up, run and stopping pattern signals representing the desired motor speed which signals are compared with a signal representing the actual motor speed to generate an error signal. The error signal is utilized to adjust the firing angle of the SCRs to maintain the actual motor speed equal to the desired motor speed.

One form of speed control for an elevator system has switching logic which generates a step signal representing the desired speed which signal is compared with a function generator output signal to generate an error input signal to the function generator. The function generator integrates the error input signal to generate a ramp output signal as the speed pattern. The speed pattern signal is compared with a tachometer signal representing the elevator speed to control back-to-back SCRs which conduct power to a single speed, three phase induction motor. Braking is accomplished by applying reverse a.c. power to the motor. Such a speed control is shown in U.S. Pat. No. 3,678,355.

Another form of speed control for a three phase induction motor in an elevator system controls the acceleration at start up in accordance with the difference between the actual motor speed signal and a predetermined speed command signal. At the end of the acceleration period, the motor is run at rated speed in an open loop control configuration. Braking is accomplished by applying d.c. power to the motor. Such a speed control is shown in U.S. Pat. No. 3,973,175.

SUMMARY OF THE INVENTION

The present invention concerns a speed control for an elevator system utilizing a single speed, three phase a.c. motor with back-to-back SCR switching between the motor and the power source. The speed control includes a limit on maximum jerk and acceleration up to the full speed of the motor. To start the elevator car, a velocity step pattern signal is applied to a square root element to generate a signal to an integrator circuit. A second input to the integrator circuit is a negative feedback signal from the integrator circuit output. The square root and feedback signals are summed and applied to a capacitor which integrates the summed signal to limit the value of jerk. The voltage across the capacitor is applied to an integrator which generates the integrator circuit output signal and limits the value of acceleration. The integrator circuit output signal represents the velocity pattern for the motor. This pattern signal is applied to a trigger circuit which controls the firing angles of the SCRs to maintain the desired speed. After the acceleration portion of the pattern is completed, a constant magnitude pattern representing the rated speed of the motor is generated.

When an a.c. motor is accelerating a lowering load to the rated speed, the car tends to overspeed and there is a "bump" when a prior art control switches to a.c. plugging to brake the motor. Also, if the control is not properly programmed, the car speed can be oscillated about the rated speed between upper and lower speed control limits representing a.c. plugging and a.c. driving respectively. In the present invention, the car is accelerated to rated speed and, if the car speed exceeds the rated speed by a first predetermined amount, such as 25 feet per minute, all of the SCRs are shut off. If the car exceeds the rated speed by a second predetermined amount higher than the first predetermined amount, the power supply and SCRs are reverse connected to the motor windings. If the car speed exceeds the rated speed by a third predetermined amount higher than the second predetermined amount, the SCRs are turned on to apply reverse power to the motor to slow the car to the rated speed. However, at the second higher speed, the magnitude of the speed pattern signal is increased so that when reverse power is applied, the car will not jump back to rated speed and produce a bumpy ride. Instead the car speed is controlled at the increased magnitude pattern signal.

It is an object of the present invention to reduce the cost and complexity of electric motor and elevator control systems.

It is another object of the present invention to limit values of jerk and acceleration during the start up of an elevator car.

It is a further object of the present invention to reduce the "bump" and "hunting" associated with the control of elevator car overspeed conditions.

DESCRIPTION OF THE PREFERRED EMBODIMENT

Figure 1:
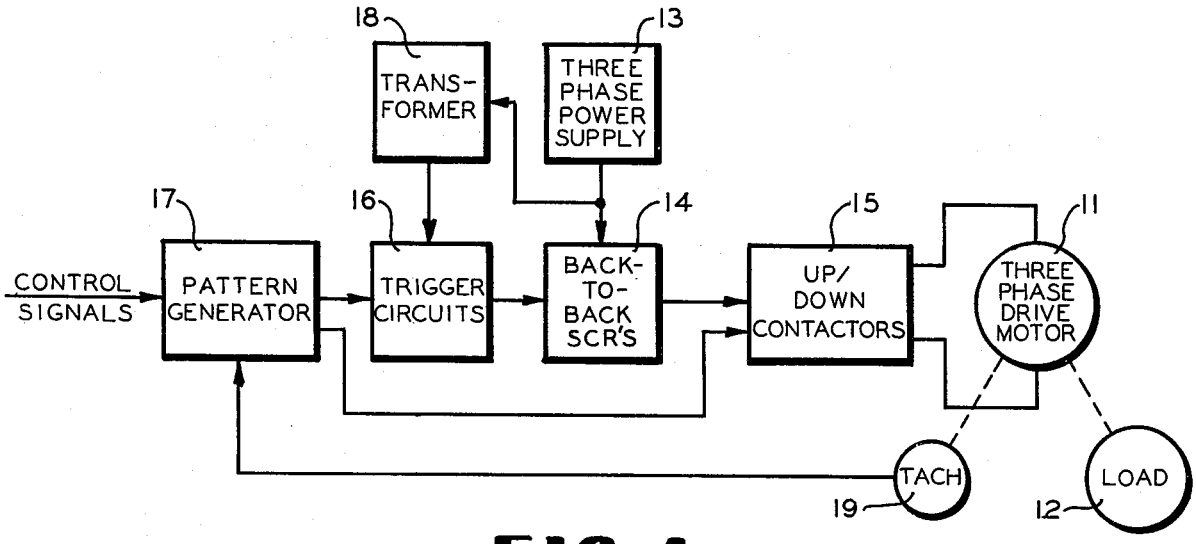
FIG. 1 is a block diagram of an electric motor speed control system according to the present invention.

There is shown in FIG. 1 a block diagram of a speed control system for an electric motor in accordance with the present invention. This speed control system is particularly useful for controlling the speed of an elevator drive motor during start-up and rated speed running. A drive motor 11, typically a three phase, single speed, a.c. induction-type motor, is mechanically coupled to a load 12 which can be the hoist sheave in an elevator system. The drive motor 11 receives electrical power from a three phase power supply 13 through back-to-back SCRs 14 and a set of up/down contactors 15. The firing angles for the SCRs 14 are controlled by trigger circuits 16 in accordance with a velocity pattern signal generated by a pattern generator 17 and synchronized with the three phase power through a transformer 18 connected to the power lines from the power supply 13. The pattern generator 17 also generates signals to the up/down contactors to determine the direction of rotation of the drive motor 11 and to reverse the direction of current flow for a.c. braking when desired. A tachometer 19 is mechanically coupled to the drive motor 11 to generate a signal representing the actual speed of the drive motor 11 to the pattern generator 17. Although the pattern generator operates open loop for speed control, the actual speed signal is utilized for comparison purposes in an overspeed circuit to be discussed below and to obtain distance information when stopping the car at a floor. The pattern generator 17 operates in response to start and stop control signals generated by conventional control circuitry.

Figure 3:
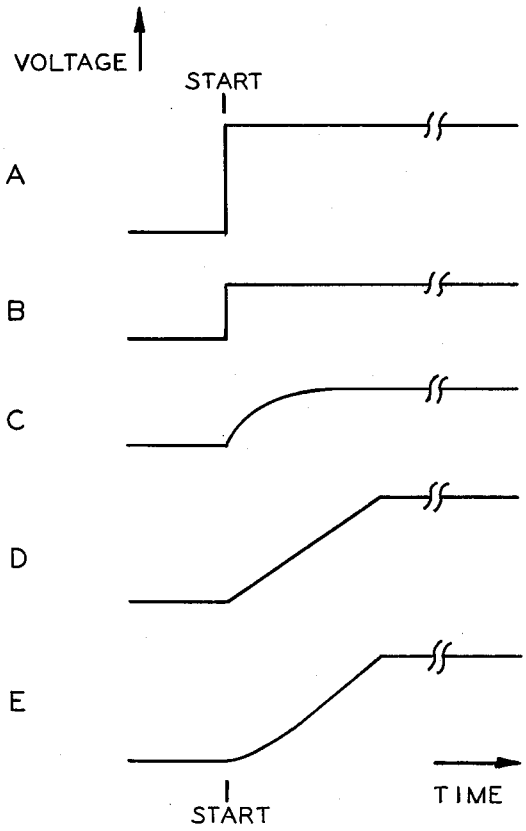
FIG. 3 is a plot of voltage versus time for several of the waveforms generated in the circuit of FIG. 2.
Figure 2:
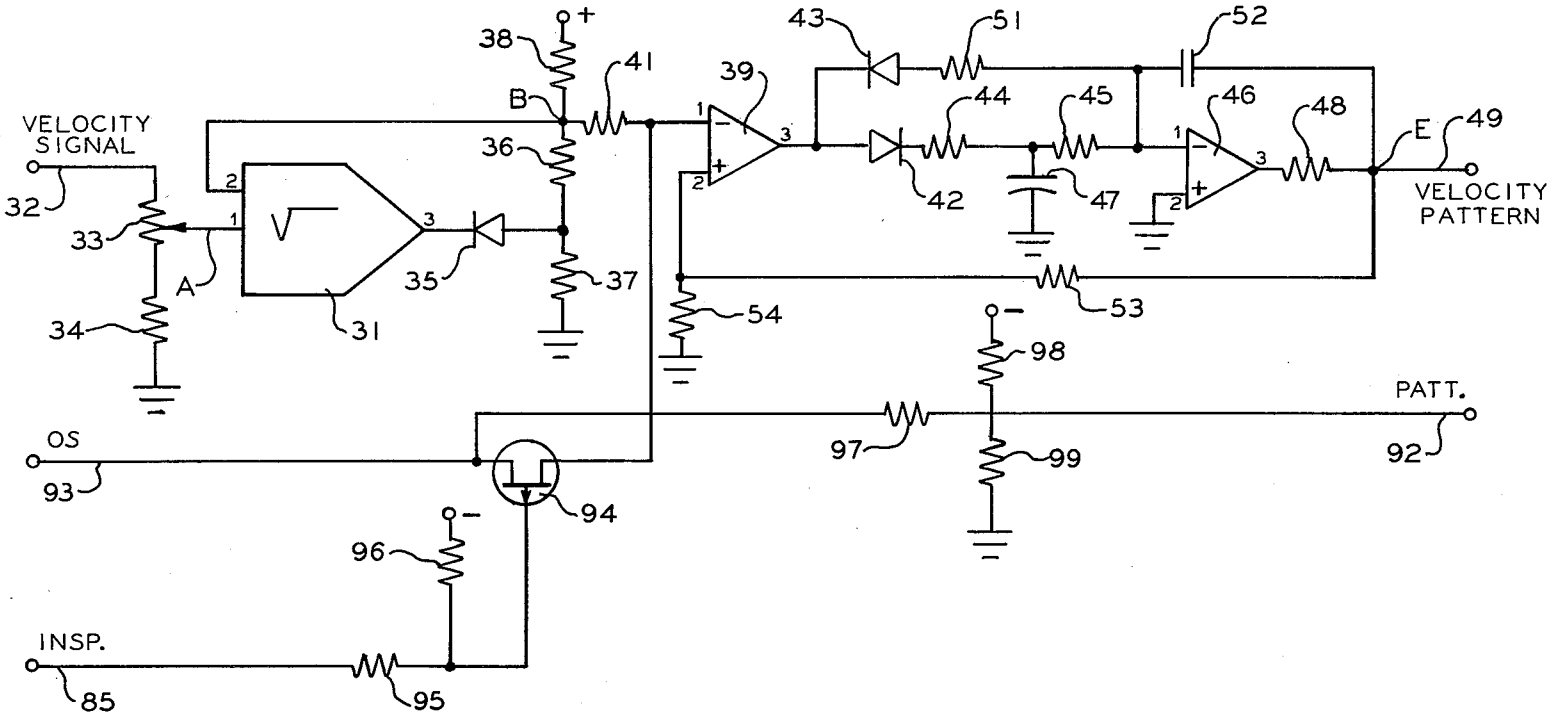
FIG. 2 is a schematic diagram of the start-up and rated speed pattern generating circuit of the pattern generator of FIG. 1.

The pattern generator 17 includes circuitry for generating a velocity pattern to the trigger circuit 16 and circuitry for controlling the trigger circuit 16 and the up/down contactors 15 during an overspeed condition such as when accelerating a lowering load. There is shown in FIG. 2 a schematic diagram of the start-up and rated speed pattern generating circuit included in the pattern generator 17 of FIG. 1. There is shown in FIG. 3 plots of voltage vs. time for several of the wave forms generated in the circuit of FIG. 2.

A square root element 31 has an input 31-1 connected to an input line 32 through the tap of a potentiometer 33. The input line 32 is connected to the ground potential of the system through the potentiometer 33 and a series connected resistor 34. Thus, the portion of the velocity signal determined by the position of the tap point of the potentiometer 33 is an input to the square root element 31 which generates an output signal at an output 31-3. The input signal to the square root element 31 is typically a step velocity signal shown as wave form A of FIG. 3. The output 31-3 is connected to a cathode of the diode 35 having an anode connected to the junction of a pair of resistors 36 and 37. The resistor 37 has an end, opposite the end connected to the junction, connected to the circuit ground potential and the resistor 36 has an end, opposite the end connected to the junction, connected to a positive polarity power supply (not shown) through a resistor 38 and to an inverting input 39-1 of an operational amplifier 39 through a resistor 41. The junction of the resistors 36, 38 and 41 is also connected to an input 31-2 of the square root element 31 to provide a feedback signal. The wave form generated at a junction of the resistors 36, 38 and 41 is shown as the wave form B in FIG. 3.

The operational amplifier 39 has an output 39-3 connected to an anode of a diode 42 and a cathode of a diode 43. The diode 42 has a cathode connected through a pair of series connected resistors 44 and 45 to an inverting input 46-1 of an operational amplifier 46. A capacitor 47 is connected between the junction of the resistors 44 and 45 and the circuit ground potential. The operational amplifier 46 has a non-inverting input 46-2 connected to the circuit ground potential and an output 46-3 connected through a resistor 48 to a velocity pattern output line 49. The diode 43 has an anode connected to the inverting input 46-1 through a resistor 51. A capacitor 52 is connected between the inverting input 46-1 and the output line 49. The operational amplifier 39 has a non-inverting input 39-2 connected to the output line 49 through a resistor 53 and to the circuit ground potential through a resistor 54. The operational amplifier 39 sums the output signal from the square root element 31, shown as wave form B of FIG. 3, and a feedback signal representing a portion of the velocity pattern signal on the output line 49 as determined by the values of the resistors 53 and 54 which function as a voltage divider. The sum of the input signals is generated at the output 39-3 and applied to the capacitor 47 through the diode 42 and the resistor 44. The capacitor 47 will charge with a time constant determined by the values of the resistor 44 and the capacitor 47. The capacitor will respond to the step velocity signal shown as wave form B to generate an exponential wave form C as shown in FIG. 3. The operational amplifier 46 and the capacitor 52 function as an integrator for generating the velocity pattern signal on the output line 49. This integrator would respond to the step velocity signal shown as wave form B to generate a ramp signal shown as wave form D of FIG. 3.

The velocity signal represented by the wave form B has infinite values of jerk (the rate of change of acceleration) and acceleration. If such a signal is utilized to control the drive motor 11 in an elevator system, the result is an uncomfortable ride for the passengers. The integration of the wave form B by the operational amplifier 46 and capacitor 52 integrator produces the wave form D which has a predetermined value of acceleration determined by the values of the capacitor 52 and the resistor 45, but still includes an infinite value of jerk which is unacceptable for passenger comfort. The capacitor 47 integrates the sum of the square root element output signal, represented by the wave form B, and the feedback signal to reduce the jerk such that the velocity pattern signal, represented by the wave form E, has predetermined values of both jerk and acceleration. The values of the resistor 44 and the capacitor 47 determine one predetermined value of jerk during acceleration. When the car is to stop, the values of the capacitor 52 and the resistor 51 determine the rate of deceleration and the values of the resistors 45 and 51 and the capacitor 47 determine another predetermined value of jerk as the capacitor 47 discharges through the diode 43 when the step signal is removed from the input 39-1 to stop the elevator car.

In summary, the circuit of FIG. 2 limits values of jerk and acceleration during the start-up of an elevator car. This circuit is responsive to a step velocity signal applied to an input line 32 to generate a velocity pattern signal at an output line 49 to the trigger circuits 16 of FIG. 1. Since a step signal represents unlimited values of jerk and acceleration, the circuit of FIG. 2 utilizes the capacitor 47 to limit the value of jerk to a predetermined value and the integrator, represented by the operational amplifier 46 and the capacitor 52, to limit the value of acceleration during the start-up portion of a velocity pattern signal. The step input signal is applied to a square root element 31 which generates one input signal to an operational amplifier 39. The other input signal to the operational amplifier 39 is a feedback signal of a portion of the velocity pattern signal and the two input signals are summed and applied to the capacitor 47. The voltage across the capacitor 47 is applied to the operational amplifier 46 which generates the velocity pattern signal on the output line 49.

Figure 4:
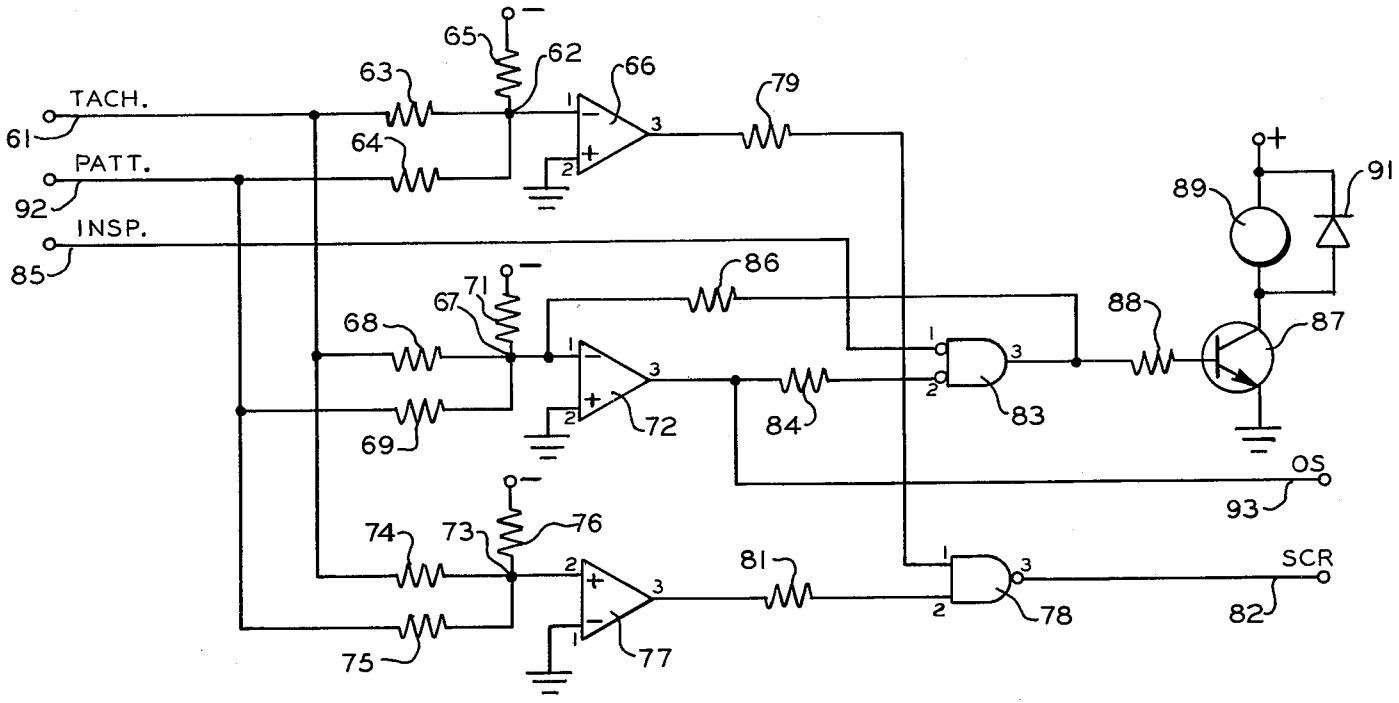
FIG. 4 is a schematic diagram of the overspeed circuit of the pattern generator of FIG. 1.

FIG. 4 is a schematic diagram of the overspeed circuit in the pattern generator 17 of FIG. 1. The output signal from the tachometer 19 of FIG. 1 is applied to an input line 61 which is connected to a summing point 62 through a current limiting resistor 63. A pattern signal output line 92 of FIG. 2 is an input to the overspeed circuit of FIG. 4 and is connected to the summing point 62 through a current limiting resistor 64. A negative polarity power supply (not shown) is also connected to the summing point 62 through a current limiting resistor 65. The summing point 62 is connected to an inverting input 66-1 of an operational amplifier 66 having a non-inverting input 66-2 connected to the circuit ground potential.

The tachometer signal line 61 and the pattern signal line 92 are also connected to a summing point 67 through a pair of current limiting resistors 68 and 69 respectively. The negative polarity power supply (not shown) is connected to the summing point 67 through a current limiting resistor 71. The summing point 67 is connected to an inverting input 72-1 of an operational amplifier 72 having a non-inverting input 72-2 connected to the circuit ground potential.

The tachometer signal line 61 and the pattern signal line 92 are also connected to a summing point 73 through a pair of current limiting resistors 74 and 75. The negative polarity power supply (not shown) is connected to the summing point 73 through a current limiting resistor 76. The summing point 73 is connected to a non-inverting input 77-2 of an operational amplifier having an inverting input 77-1 connected to the circuit ground potential. The operational amplifiers 77, 72 and 66 detect the lower, middle and upper overspeed limits respectively. The tachometer signal and the pattern signal typically can have the same magnitude representing the same speed and be opposite in polarity. For example, if the tachometer signal is positive in polarity and the pattern signal is negative in polarity and the values of the resistors 63 and 64 are equal, then there will be a negative net current flowing into the summing point 62 when the velocity pattern signal exceeds the tachometer signal, zero current flowing into the summing point 62 when the magnitudes of the tachometer and pattern signals are equal and a positive net current flowing into the summing junction 62 when the magnitude of the tachometer signal exceeds the magnitude of the pattern signal. The magnitude of the negative polarity power supply and the value of the resistor 65 will then determine the magnitude and polarity of the current flowing into the inverting input 66-1 of the operational amplifier 66. If the values of the resistors 63, 64, 67, 68, 74 and 75 are equal, then the values of the resistors 65, 71 and 76 can be set such that the polarity of the current flow into the inputs 66-1, 72-1 and 77-2 respectively will switch when the magnitude of the tachometer signal exceeds the magnitude of the pattern signal by first, second and third predetermined values.

An output 66-3 of the operational amplifier 66 is connected to an input 78-1 of an NAND gate 78 through a resistor 79. An output 77-3 of the operational amplifier 77 is connected to an input 78-2 of the NAND 78 through a resistor 81. The NAND 78 has an output 78-3 connected to a SCR control signal line 82. The operational amplifier 72 has an output 72-3 connected to an input 83-2 of a NOR gate 83 through a resistor 84. An inspection signal input line 85 is connected to an input 83-1 of the NOR 83. An output 83-3 of the NOR 83 is connected to the inverting input 72-1 of the operational amplifier 72 through a resistor 86 and to a base of an NPN transistor 87 through a resistor 88. The transistor 87 has an emitter connected to the circuit ground potential and a collector connected to a positive potential power supply (not shown) through a relay coil 89. A diode 91 has an anode connected to the collector of the transistor 87 and a cathode connected to the positive potential power supply (not shown) to provide a discharge current path for the relay coil 89.

Figure 5:
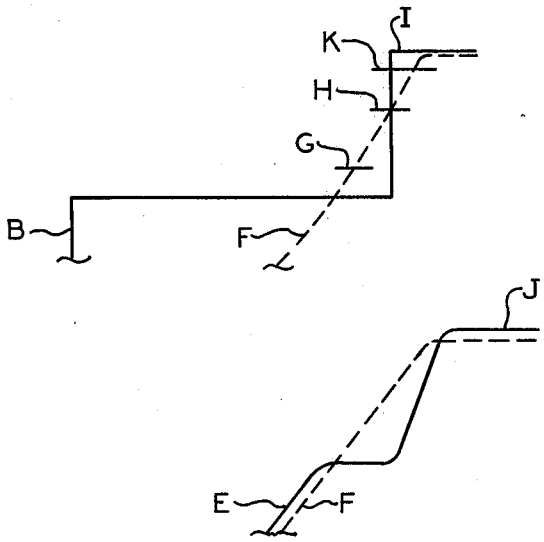
FIG. 5 is a plot of voltage versus time for the pattern generator and tachometer signals for overspeed operation of the pattern generator of FIGS. 1 and 4.

There is shown in FIG. 5 a plot of voltage versus time for the pattern generator signal B and the tachometer signal F which signals appear on the lines 92 and 61 respectively. The actual car speed represented by the tachometer signal F lags the pattern signal B due to the inertia of the elevator system. When the drive motor control system of FIG. 1 accelerates a lowering load, such as a loaded elevator car, the actual car speed will tend to increase beyond the rated speed magnitude of the pattern signal and the motor must be braked. Many prior art systems simply sense that the actual speed has exceeded the desired speed and apply either a.c. or d.c. braking to the drive motor. Such operation can tend to cause a "bump" or "hunting" operation of the elevator car.

The overspeed circuit of FIG. 4 includes an OS (overspeed) output line 93 connected to the output 72-3 of the operation of amplifier 72. The OS line is an input to the pattern generator circuit of FIG. 2, being connected to one side of a FET (field effect transistor) 94. The other side of the FET 94 is connected to the input 39-1 of the operational amplifier 39 and a gate of the FET 94 is connected through a resistor 95 to the inspection signal line 85. The gate of the FET 94 is also connected to the negative polarity power supply (not shown) through a resistor 96 to obtain gate current to maintain the FET 94 turned on when the inspection signal on the line 85 is at the zero logic level. The OS input line 93 is also connected to the pattern signal line 92 through a resistor 97. The pattern signal line 92 is connected to the negative polarity power supply (not shown) through a resistor 98 and to the circuit ground potential through a resistor 99.

There is shown in FIG. 5 a plot of voltage versus time for the pattern signal wave form B, the velocity pattern signal wave form E, and the tachometer signal wave form F. When lifting a load, the magnitude of the pattern signal B will always exceed the magnitude of the tachometer signal F, but the pattern signal is negative in polarity whereas the tachometer signal is positive in polarity. Therefore, the net currents at the summing points 62, 67 and 73 will normally be negative in polarity. The operational amplifier 77 will generate a negative polarity signal at the input 78-2 of the NAND 78 which represents a logic zero signal. The NAND 78 responds by generating a logic one signal on the SCR output line 82 to enable the trigger circuit 16 of FIG. 1.

When accelerating a lowering load, the magnitude of the tachometer signal F can exceed the magnitude of the pattern signal B. At a predetermined first value G, the positive polarity current generated by the tachometer signal on the line 61 will cause the net current to be positive in polarity and the operational amplifier 77 will switch from a negative polarity output to a positive polarity output to generate a logic one signal at the input 78-2 of the NAND 78.

The value of the resistor 65 is less than the value of the resistor 76 such that the current at the summing point 62 continues to have a negative polarity after the current at the summing point 73 has switched polarity. Therefore, the operational amplifier 66 continues to generate a positive polarity output signal and the NAND 78 has both inputs at logic one to generate a logic zero on the line 82 turning off the trigger circuit 16 of FIG. 1. The value of the resistor 71 is between the values of the resistors 76 and 65. Therefore, when the magnitude of the tachometer signal F exceeds a second predetermined value H, the current at the summing point 67 changes from a negative polarity to a positive polarity. Since there has been no request for the generation of inspection pattern signal, the inspection signal on the line 85 is at logic zero. When the operational amplifier 72 changes its output from a positive polarity to a negative polarity signal, both inputs to the NOR 83 will be at zero and the output signal will change from a logic zero to a logic one. The logic one signal will turn on the transistor 87 and current will flow through the relay coil 89 actuating the relay which reverses the up/down contactors 15 of FIG. 1. For example, since the elevator car was being lowered, the down contactors were closed. The actuation of the relay opens the down contactors and closes the up contactors such that the application of power to the drive motor 11 will generate a.c. braking.

The logic one signal generated by the NOR 83 is applied to the input 72-1 as a positive polarity current. Thus, the operational amplifier 72 will continue to generate a negative polarity output signal. The negative polarity output signal from the operational amplifier 72 is also generated on the overspeed line 93 to the pattern generator circuit of FIG. 2. The signal on the line 93 is added to the wave form B to increase the magnitude of the pattern signal on the line 92 to a value I. This increase in the magnitude of the pattern signal will increase the negative current at the summing junction 67, but the positive polarity feedback current through the resistor 86 will more than offset the increased negative polarity current such that the operational amplifier 72 remains in the switched condition. However, the increased negative polarity current from the pattern signal switches the operational amplifier 77 back to its original condition wherein it generates a logic zero signal to the NAND 78. The NAND 78 responds by generating a logic one on the SCR line 82 to enable the trigger circuits 16 and apply a.c. power to brake the drive motor.

The increase I in the pattern signal B is also reflected in the velocity pattern signal on the line 49 as an increase J and the drive motor will be controlled at the new velocity pattern level J. This prevents the drive motor from jumping back to the rated speed level of the wave form E resulting in a "bump." If the magnitude of the tachometer signal F exceeds a third value K, either before the pattern signal B is raised to the magnitude I or the increase in the pattern signal is not generated at all, the current at the summing point 62 will change from a negative to a positive polarity. Then the operational amplifier 66 will generate a logic zero signal to the NAND 78 to generate a logic one on the SCR output line 82 and enable the trigger circuits 16 thereby a.c braking the drive motor 11.

In summary, the overspeed circuit of FIG. 4 is responsive to the magnitudes of the pattern signal on the line 92 and the tachometer signal on the line 61 for detecting an overspeed condition of the drive motor, for turning off the SCR trigger circuits 16 when the actual speed exceeds the desired speed by a first predetermined value and for reversing the up/down contactors 15 and turning on the SCR trigger circuits 16 when the actual speed exceeds the desired speed by a second higher predetermined value. The magnitude of the pattern signal is also increased at the second predetermined value such that there is no "bump" when the a.c. braking is applied. The drive motor is then controlled at this new desired speed value J.

In summary, the present invention concerns a motor control system for controlling an electric drive motor, such as an elevator drive motor, at a desired speed. The control system includes a source of electric power, means for generating a speed control signal representing the desired speed and having predetermined values of positive jerk and acceleration, and means responsive to the desired speed signal connecting the power source to the motor to maintain the motor at the desired speed. The speed control signal generating means includes a source of a signal representing rated speed for the drive motor, means responsive to the rated speed signal and a feedback signal for generating an output signal defining a predetermined value of jerk, means responsive to the output signal for generating the pattern signal defining the predetermined value of jerk and predetermined value of acceleration, and means responsive to the pattern signal for generating the feedback signal. The rated speed signal source can be a source of a step signal and means responsive to the step signal for generating a signal having magnitude representing the square root of the magnitude of this step signal. The square root signal is then applied to a capacitor which limits the value of jerk and the voltage across the capacitor is applied to an integrator which limits the value of acceleration. The integrator output signal is the desired speed signal and a portion of this signal is generated as the feedback signal.

The present invention also includes means for generating a signal representing the actual speed of the motor, means responsive to the actual speed signal and the desired speed signal for generating a disconnect signal when the actual speed exceeds the desired speed by a first predetermined amount, the connecting means being responsive to the disconnect signal for disconnecting the power source from the motor, and means responsive to the actual speed signal and the desired speed signal for generating a reverse signal when the actual speed exceeds the desired speed by a second predetermined amount, the connecting means being responsive to the reverse signal for connecting the power source to the motor to apply dynamic braking to the motor.

In accordance with the provisions of the patent statutes, the principal mode of operation of the invention has been explained and illustrated in its preferred embodiment. However, it must be understood that the invention may be practiced otherwise than as specifically illustrated and described without departing from its spirit or scope.

What is claimed is:

1. In an elevator system including an electric drive motor, a source of electric power, means for generating a desired starting speed pattern signal, and means responsive to the pattern signal for connecting the power source to the drive motor to control the drive motor according to the desired starting speed pattern, the pattern signal generating means comprising:

a source of a signal representing rated speed for the drive motor;

means responsive to said rated speed signal for generating an output signal defining a predetermined value of jerk; and means responsive to said output signal for generating the pattern signal defining said predetermined value of jerk and a predetermined value of acceleration.

2. A pattern signal generating means according to claim 1 wherein said signal source includes a source of a step signal and means for generating said rated speed signal with a magnitude equal to the square root of the magnitude of said step signal.

3. A pattern signal generating means according to claim 2 wherein said means for generating said output signal includes a capacitor and means for charging said capacitor with said rated speed signal, the voltage across said capacitor representing the magnitude of said output signal.

4. A pattern signal generating means according to claim 3 including an integrator responsive to the voltage across said capacitor for generating the pattern signal.

5. A pattern signal generating means according to claim 2 including means responsive to the pattern signal for generating a feedback signal and wherein said means for generating said output signal includes a capacitor and means for charging said capacitor with the sum of said rated speed signal and said feedback signal, the voltage across said capacitor representing the magnitude of said output signal.

6. In a motor control system for controlling an electric motor at a desired speed including a source of electric power, means for generating a speed control signal representing the desired speed and having predetermined values of positive jerk and acceleration, and means responsive to the desired speed signal for connecting the power source to the motor to maintain the motor at the desired speed, the speed control signal generating means comprising:

a source of a step signal;

means responsive to said step signal for generating a signal having a magnitude representing the square root of the magnitude of said step signal;

means for integrating said square root signal to generate an output signal defining the predetermined value of jerk; and means for integrating said output signal to generate the speed control signal defining the predetermined value of acceleration.

7. A speed control signal generating means according to claim 6 including means responsive to the speed control signal for generating a feedback signal and means for generating a signal representing the sum of said square root signal and said feedback signal and wherein said output signal generating means integrates said summed signal to generate said output signal.

8. A speed control signal generating means according to claim 7 wherein said output signal generating means includes a capacitor and means for charging said capacitor with said summed signal, the voltage across said capacitor representing the magnitude of said output signal.

9. In an elevator system including an electric drive motor, a source of electric power, means for generating a desired speed pattern signal, and means responsive to the desired speed pattern signal for connecting the power source to the drive motor to control the drive motor according to the desired speed pattern, the pattern signal generating means comprising:

means for generating a signal representing the actual speed of the motor;

means responsive to said actual speed signal and the desired speed pattern signal for generating a disable signal when the magnitude of the actual speed signal exceeds the magnitude of the desired speed pattern signal by a first predetermined amount, the connecting means being responsive to said disable signal for removing power from the motor; and means responsive to said actual speed signal and the desired speed pattern signal for generating an overspeed signal when the magnitude of said actual speed signal exceeds the magnitude of the desired speed pattern signal by a second predetermined amount, the connecting means being responsive to said overspeed signal for reverse connecting the power source to the motor for dynamic braking.

10. A pattern signal generating means according to claim 9 including means responsive to said overspeed signal for increasing the magnitude of the desired speed pattern signal.

11. A pattern signal generating means according to claim 9 including means responsive to said actual speed signal and the desired speed pattern signal for generating an enable signal when the magnitude of said actual speed signal exceeds the magnitude of the desired speed pattern signal by a third predetermined amount, the connecting means being responsive to said enable signal for applying power to the motor.

12. In a motor speed control system for controlling an electric motor at a desired speed including a source of electric power, means for generating a speed control signal representing the desired speed, and means responsive to the speed control signal for connecting the power source to the motor to maintain the motor at the desired speed, the speed control signal generating means comprising:

means for generating a signal representing the actual speed of the motor;

means responsive to said actual speed signal and the desired speed signal for generating a disable signal when the magnitude of said actual speed signal exceeds the magnitude of the desired speed signal by a first predetermined amount, the connecting means being responsive to said disable signal for removing the power from the motor; and means responsive to said actual speed signal and the desired speed signal for generating an overspeed signal when the magnitude of said actual speed signal exceeds the magnitude of the desired speed signal by a second predetermined amount, the connecting means being responsive to said overspeed signal for reverse connecting the power source to the motor to brake the motor.

13. A speed control signal generating means according to claim 12 including means responsive to said actual speed signal and the desired speed signal for generating an enable signal when the magnitude of said actual speed signal exceeds the magnitude of the desired speed signal by a third predetermined amount, the connecting means being responsive to said enable signal for applying power from the power source to the motor.

14. A speed control signal generating means according to claim 12 including means responsive to said overspeed signal for increasing the magnitude of the desired speed signal.

* * * * *